US005669765A

United States Patent [19]

Moller et al.

[11] Patent Number: 5,669,765

[45] Date of Patent: Sep. 23, 1997

[54] PAIR OF CONVEYOR WORMS FOR ROTARY POSITIVE-DISPLACEMENT PUMPS

[76] Inventors: Heinrich Moller; Henning Moller, both of Bohnenkampstrasse 11, Obernkirchen, Germany, D-31683

[21] Appl. No.: 683,914

[22] Filed: Jul. 19, 1996

Related U.S. Application Data

[63] Continuation of Ser. No. 373,277, filed as PCT/DE93/00595, Jul. 3, 1993 published as WO94/03730, Feb. 17, 1994, abandoned.

[30] Foreign Application Priority Data

Jul. 29, 1992 [DE] Germany ..... 42 24 969.4

[51] Int. Cl.[6] ..... F04C 2/16

[52] U.S. Cl. ..... 418/1; 418/201.3

[58] Field of Search ..... 418/1, 9, 201.3, 418/202

[56] References Cited

U.S. PATENT DOCUMENTS 3,288,077 11/1966 Meskat ..... 418/202

FOREIGN PATENT DOCUMENTS

| | | | |
|---|---|---|---|
| 763458 | 2/1934 | France | 418/202 |
| 594691 | 3/1934 | Germany . | |
| 1553271 | 2/1970 | Germany . | |
| 254986 | 7/1926 | United Kingdom | 418/201.3 |
| 2165890 | 4/1986 | United Kingdom | 418/201.3 |

*Primary Examiner*—John J. Vrablik

*Attorney, Agent, or Firm*—Whitham, Curtis, Whitham & McGinn

[57] ABSTRACT

A pair of conveyor screws for rotating positive-displacement pumps, the conveyor screws including a rotor and a contra-rotor, wherein the conveyor screws comprise a screw spindle pump and rotate with zero contact in a bore and in flanks and rotate at the same speed, the conveyor screws form loss gaps and have the same thread depth, the same number of threads and flank profiles which are symmetrical. The conveyor screws include a tooth base positioned below a flank profile reversing point and a tooth head positioned above the flank profile reversing point, wherein a profile-produced loss gap height in an axial section on a pitch circle is kept constant for a specific rotor diameter by shifting the flank profile reversing point as a function of a rotor pitch.

19 Claims, 8 Drawing Sheets

S
H r=1=RK/RK
B
B1
B2
m=RT/RK
q=Rq/RK
e
v=RF/RK
αU
αö
αSF
αm
A
C
C'
αSK
E
β
MI
MII
D2
D1
D
r=1=RK/RK

S H $r=1=\frac{R_K}{R_K}$
$q=\frac{R_q}{R_K}$
$m=\frac{R_T}{R_K}$
$v=\frac{R_F}{R_K}$
B
$B_1$
$B_2$
e
αm
αö
αSK
αSF
αU
β
MI
MII
A
C
C'
E
D
$D_1$
$D_2$

PAIR OF CONVEYOR WORMS FOR ROTARY POSITIVE-DISPLACEMENT PUMPS

This is a Continuation of Application Ser. No. 08/373,277 filed as PCT/DE93/00595, Jul. 3, 1993 published as WO94/03730, Feb. 17, 1994, abandoned.

BACKGROUND OF THE INVENTION

With screw spindle pumps it is known to provide rotating delivering elements, called rotors, with screw-shaped profiles which make up a gear tooth system. The rotors are not primarily used to transmit force. Instead, the rotors are used to seal off the delivering chamber between the suction and pressure chambers. With so called external bearing screw spindle pumps, the rotors rotate with zero contact in the bore and in the flanks. Such pumps are suitable for pumping non-lubricating, viscous media, which often contain particles of dirt and solids.

The volumetric and overall efficiency are influenced mainly by the viscosity of the delivering medium and gaps within the pump. Whereas, the pressure within the pump is influenced by the distance between bearings, the length of the rotor, the pitch of the rotor, the rotor diameter and the hub ratio. The hub ratio, referred to as "Nü", is a ratio of the tooth base diameter to the tooth head diameter.

A differentiation is made between the "circumferential gap" (this is the gap between the rotor and the surrounding rotor bore), the "base gap" (this is the gap between the outside diameter of the one rotor and the root circle diameter of the other rotor) and the "flank profile gaps" (this is the gap between the flank profiles of the rotors). With regard to the flank profile gap a differentiation is made between a gap that must be pre-set for the required zero-contact running and a profile shape-dependent gap that occurs due to the laws of a gear tooth system. The profile-dependent loss gap forms the subject of the present invention.

If the non-lubricating media to be conveyed contains solid particles, the reflux that occurs due to the counter-pressure causes abrasive wear (with any play). As a result thereof, the play increases so that after only a brief operating period the effective delivery rate of the pump is reduced. In practice, this problem is counteracted either by using several closed chambers of the rotor sequentially (i.e., increasing the number of the chambers) or by a differing the speed of the contra-rotor.

Using several closed chambers causes a lengthening of the rotor and, accordingly, requires a large distance between bearings and limits the delivering pressure due to the greater deflection. When differing the speed of the contrarotor, the rotors must have a different number of threads, therefore, the filling times increase and (especially at higher viscosities) complete filling of the chamber is prevented. A further disadvantage of asymmetric rotors is that the smallest possible rotor pitch is always greater than with symmetric rotor pairs, otherwise the tooth thickness or thread thickness is too small. This disadvantage also limits the suction head.

A conventional screw spindle pump, illustrated in FIGS. 7 and 8 has, as delivering elements, two zero contact meshing conveyor screw pairs rotating in opposite directions, each of which comprises a right-hand thread conveyor screw 1 as well as a left-hand thread conveyor screw 2. As a result of this two-flow arrangement the axial thrust is compensated. The meshing conveyor screws together with the enclosing housing 3 form individually closed delivering chambers. When rotated by a drive shaft 4 these chambers move continuously and parallel to the shafts from the suction side to the pressure side. The direction of rotation of the drive shaft determines the movement of the delivering chambers. A pressure build-up takes place linearly over the length of the delivering elements. The medium that flows in or is sucked up through the suction connection 5 of the pump is fed in the pump housing 6 in two partial flows to the two suction chambers.

The torque transmission from the driving to the driven shaft is effected by a gear drive 7, whose adjustment ensures the zero contact running of the delivering elements. Reference numeral 8 indicates a stuffing box.

The direction of rotation of the drive shaft 4 is indicated in FIG. 7 by arrow 9. FIG. 8 shows diagrammatically the pressure connection 10.

SUMMARY OF THE INVENTION

The invention relates to a pair of conveyor screws for rotating positive-displacement pumps. The conveyor screws, in the form of a rotor and a contra-rotor, rotate with zero contact in the bore and in the flanks. The flanks rotate at the same speed (screw spindle pumps) and form loss gaps between each other. The rotors have the same thread depths, the same number of threads and flank profiles which are symmetrical on both sides and, with regard to their pitch, each flank profile includes a tooth base positioned below a flank profile reversing radius and a moth head positioned above the flank profile reversing radius.

It is the object of the invention to develop a pair of conveyor screws of the type described above, having a short rotor length and a correspondingly small distance between bearing supports, with as few stages as possible, a large tooth head width, a small rotor pitch and a small circumferential gap length. The screw spindle pump according to the invention has a relatively high delivery flow and a high delivering pressure and uses only a limited amount of material.

BRIEF DESCRIPTION OF THE DRAWINGS

The invention will be explained in greater detail with reference to diagrams. With regard to the symbols and terms which are used reference is made to the "overview table".

FIG. 4 shows that the profile width gap c is kept constant for different pitches by varying the profile reversing radius q.

Overview Table

Lo: distance between the supporting bearings of the rotor.
Fo-l: rotor length.
A: distance between centers of the supporting bearings.
H: rotor pitch.
S: tooth head width.
$D_K$: total head diameter=2×rotor radius ($R_K=D_K/2$).
$D_F$: tooth base diameter ($R_F=D_F/2$).
$D_\tau$: mid-diameter=2×mid radius ($R_\tau=D_\tau/2$).
Nü: hub ratio $D_F/D_K$.
m: dimensionless partial circle radius ($R_\tau/R_K$).
q: dimensionless profile reversing radius ($R_q/R_K$).
$q_{min}$: minimum profile reversing radius.
$q_{max}$: maximum profile reversing radius.
q=1: no head gap.
q=m: no base gap.
r=1: dimensionless tooth head radius ($R_K/R_K=1$).
c: relatively constant distance in the axial section on the pitch circle of the profile-produced loss area.
$\alpha_G$: angle of wrap of the rotor by the rotor housing.
$\alpha_G$: opening angle of the surrounding rotor housing.
$\alpha_m$: profile angle in face section on the pitch circle radius.
$\alpha_{SK}$: profile angle in face section on any head radius.
$\alpha_{SF}$: profile angle in face section on any base radius.
$\alpha_{F1}$: profile angle in axis section on the head circle radius.
β: profile angle in face section on the rotor radius.

DETAILED DESCRIPTION OF PREFERRED EMBODIMENTS

Figure 4:
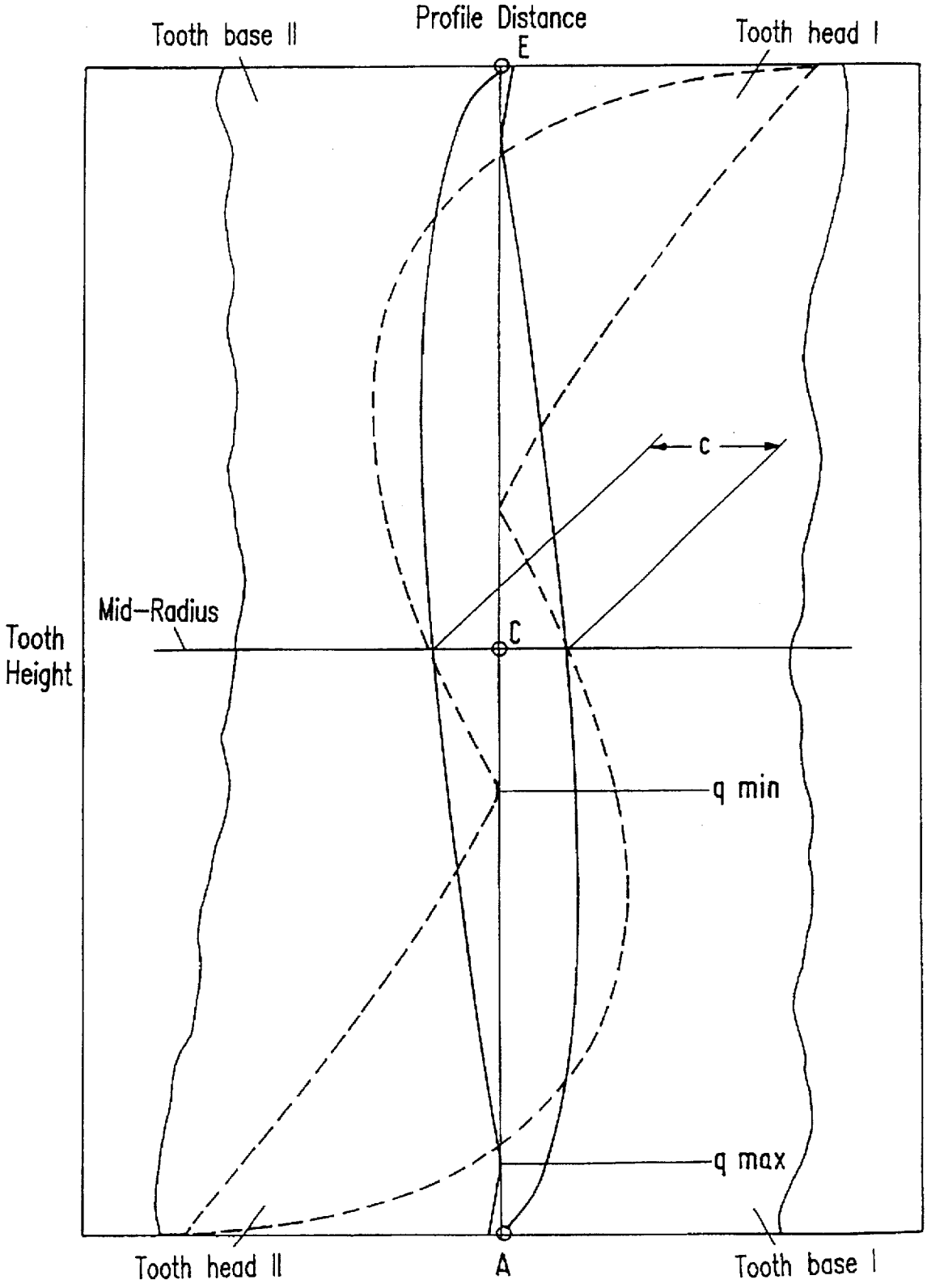
FIG. 4 shows two axial section profiles comparing q=qmax (continuous line), having a minimum technically feasible rotor pitch H, with q=qmin (dashed line), having a maximum technically feasible rotor pitch H for a pump having the same tooth base diameter $D_F$ and rotor diameter $D_K$.
Figure 5:
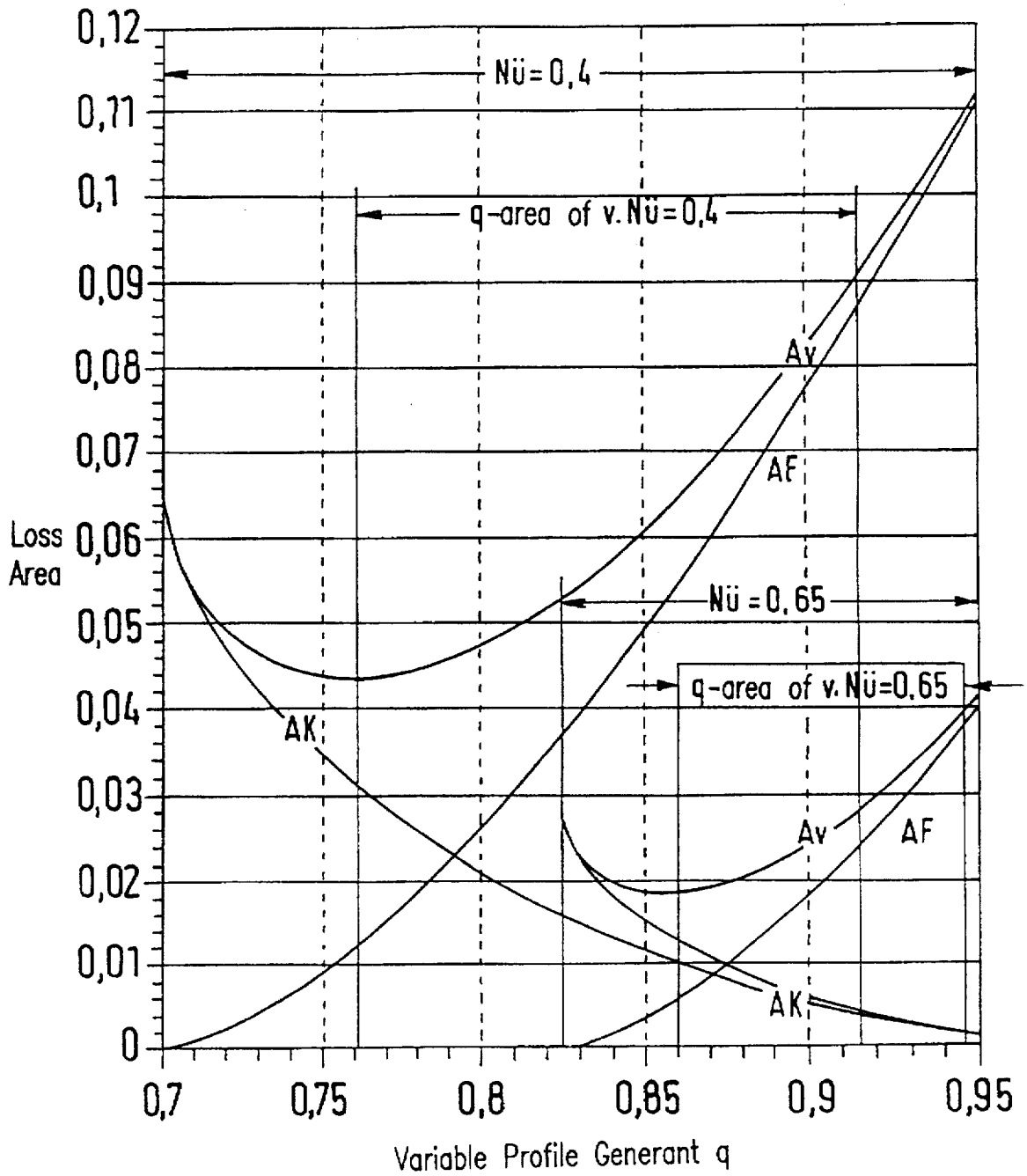
FIG. 5 illustrates the loss areas in the meshing zone in face section (shown dimensionless—$R_K/R_K=1=r$) at the tooth head and tooth base over the profile reversing radius with foot/head ratio Nü=0.4 and Nü=0.65.

Referring to FIG. 4, according to the invention the above object of the invention is achieved in that the profile-produced loss gap width c in the axial section on the pitch circle m is kept constant for a specific rotor diameter $D_K(2\times R_K)$ by shifting the flank profile reversing radius q as a function of a technically executable rotor pitch H.

Figure 3:
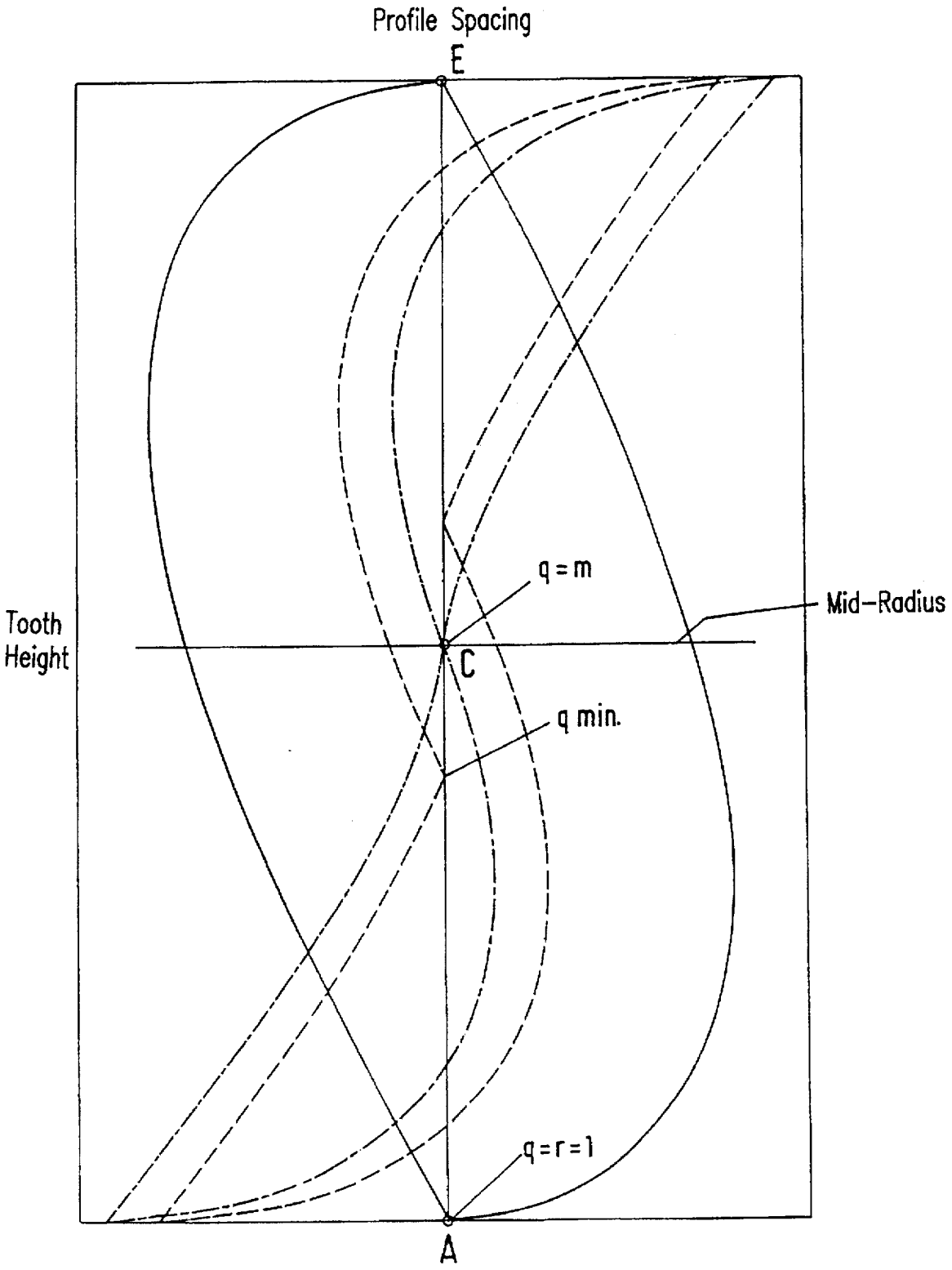
FIG. 3 shows an axial section profile gap with a comparison for q=1 (continuous line), q=m(cross-marked line), q=qmin (dot marked lines) at the same pitch H and the same rotor diameter $R_K$ ($D_K$) and the same tooth base diameter $D_F$. The axial section profile gaps c, which depend on the position of the profile reversing radius q, represent the distance between opposing flanks along the mid-radius.

FIG. 4, which corresponds to FIG. 3, shows two axial section profiles and the tooth base I and the tooth head I of the rotor 1. The same applies to rotor 2. The two axial section profiles refer to a constant rotor radius $R_K$, constant base circle radius $R_F$ and two different, technically executable pitches H. The broken-line rotor profile is created with the dimensionless profile reversing radius q equal to the minimum dimensionless profile reversing point designated by qmin. The pitch of the broken-line rotor is large.

In FIG. 4, the continuous-line rotor profile is created with the dimensionless profile reversing radius q near the dimensionless rotor radius r=1. The pitch of the continuous-line rotor is small. FIG. 4 illustrates that the gap width c in the rolling circle can be kept constant for the same sized pumps having different pitches, by shifting the profile reversing radius and/or the rotor radius. Therefore, an optimal gap width is created, which influences the fluidic properties of the profile-dependent head and base gaps in such a way that the loss flow is minimized.

By shifting the profile reversing radius q as a function of rotor pitch H, the loss gap width is held constant for a pump with a given tooth base diameter $D_F$ and rotor diameter $D_K$. The dashed line in FIG. 4 illustrates the profile of the left and right tooth of the intermeshed flanks with a maximum technically feasible rotor pitch. The profile reversing point q for the dashed line is shifted close to the minimum technically feasible profile reversing point $q_{min}$, which is close to the midpoint of the flank (mid-radius m) to maintain a constant gap with c.

The continuous line in FIG. 4 illustrates the axial section profile of the same pump with the same tooth base diameter $D_F$ and rotor diameter $D_K$, but with a minimum technically feasible rotor pitch. As shown by the continuous line, the profile reversing point is shifted close to the maximum technically feasible profile reversing point $q_{max}$ which is close to the rotor diameter $D_K$. Therefore, the gap width c is kept constant for all pumps with a given tooth base diameter $D_F$ and rotor diameter $D_K$ by shifting the profile reversing point q between $q_{min}$ and $q_{max}$.

In this connection, it is advantageous for the flank profile reversing radius q to increase as the ratio of rotor diameter $D_K=(2\times R_K)$ to rotor pitch H increases, and for the flank profile reversing radius q to increase as the rotor pitch decreases when the hub ratio Nü is constant. The flank profile reversing radius q shifts from the mid radius m up to the rotor diameter $D_K(2\times R_K)$.

Figure 1A:
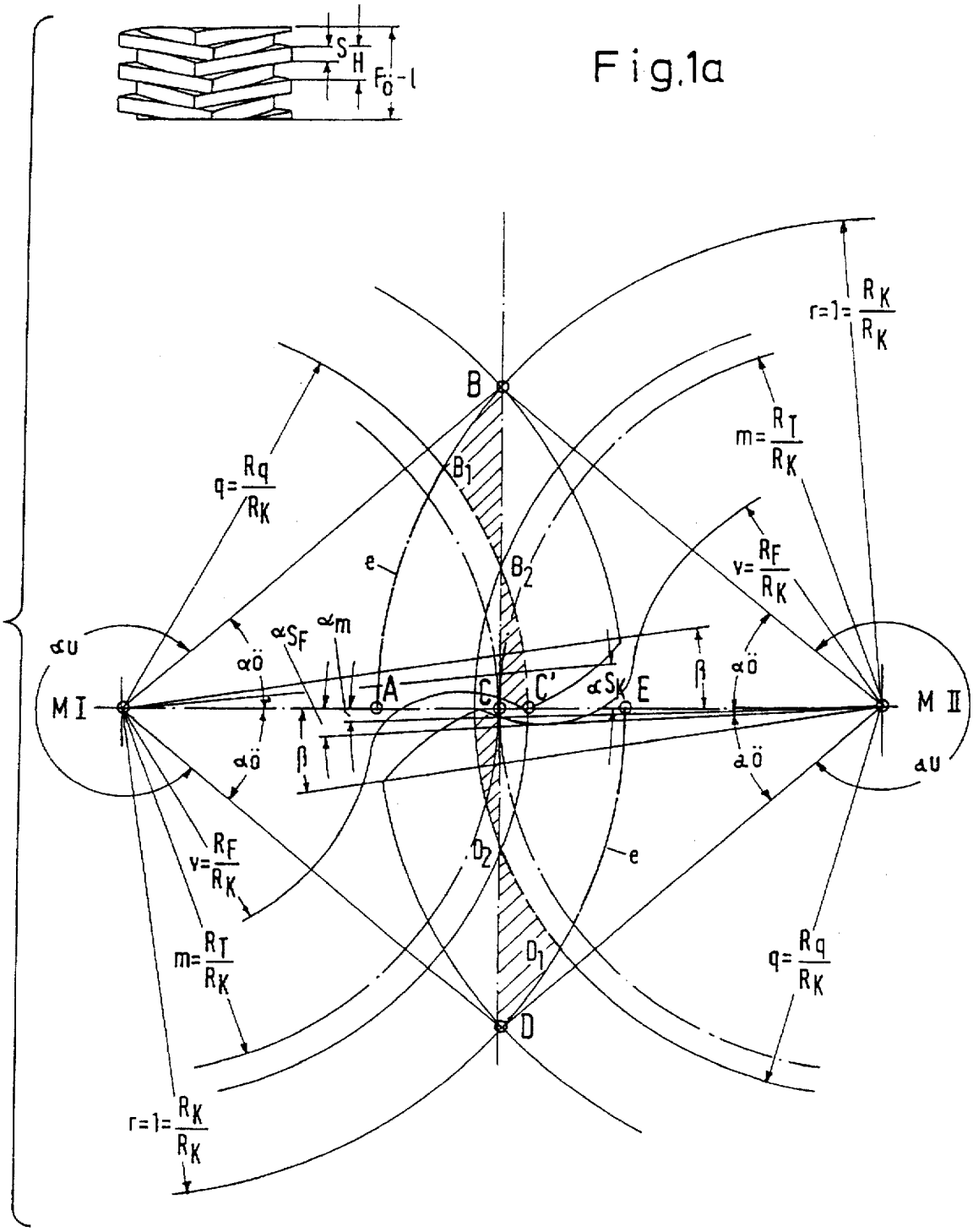
FIG. 1*a* shows a plane of action in face section for qmin.
Figure 1B:
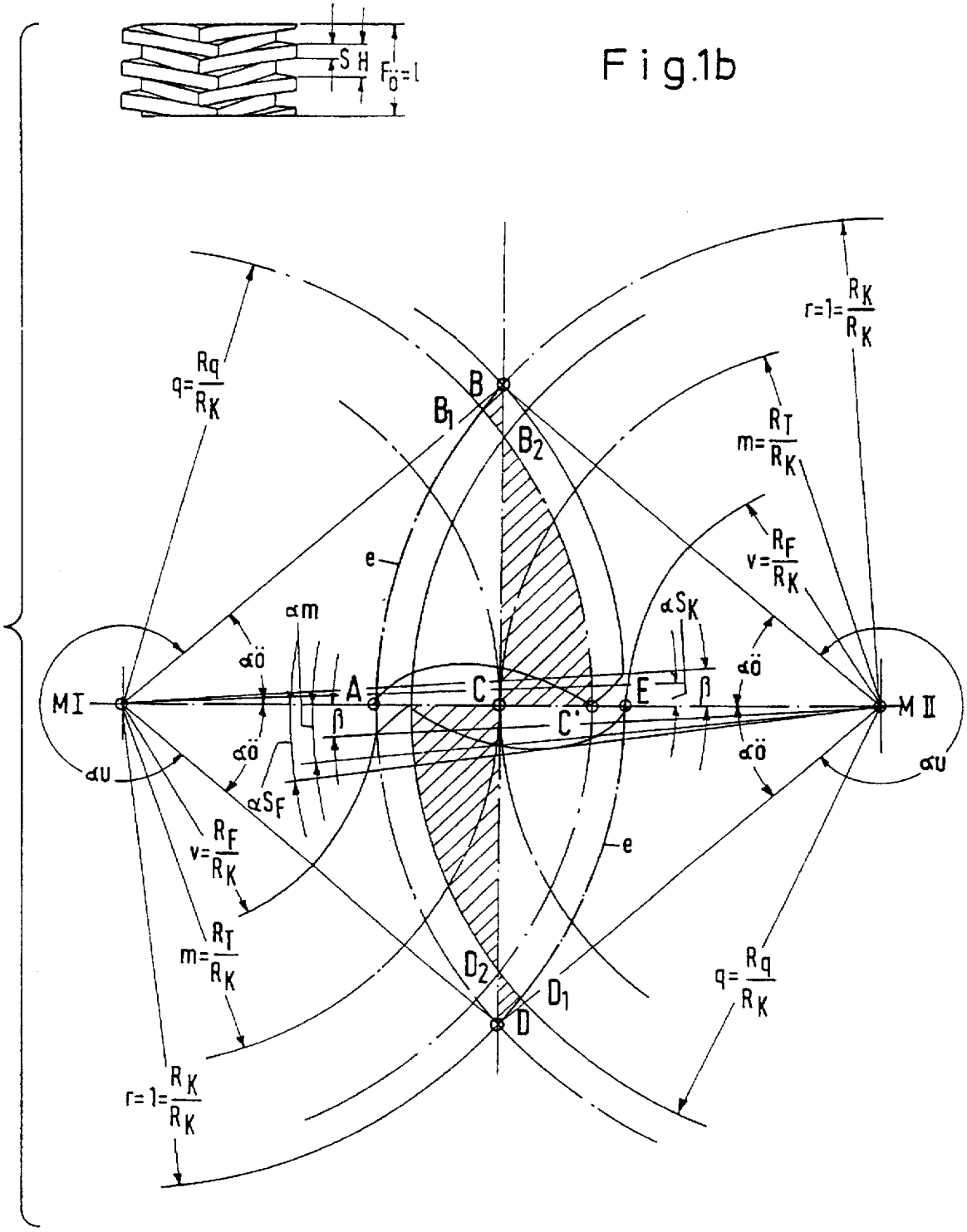
FIG. 1*b* is an illustration according to FIG. 1*a* for qmax.
Figure 2:
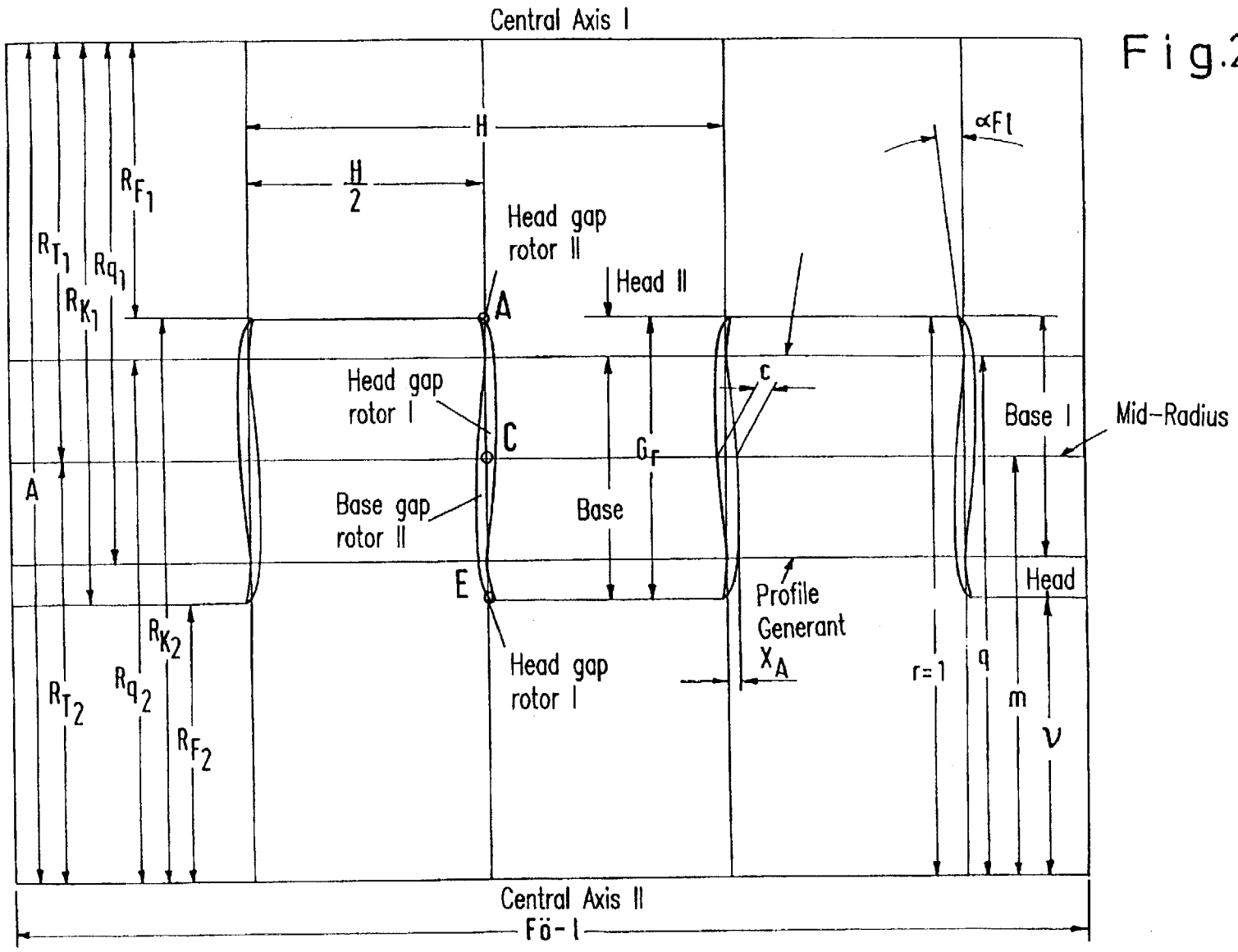
FIG. 2 shows an axial section profile.

According to the invention the disadvantages of the prior art are, in principle, overcome by the fact that the profile-produced loss gap is split up between a base loss gap $B_2C'D_2$ and a head loss gap $D_2D_1D$ (shown in FIGS. 1*a* and 1*b*). Wherein, by suitable measures the base loss gap $B_2C'D_2$, depending on the pitch, is made up to 24 times greater than the head loss gap $D_2D_1D$. FIG. 1*a* illustrates a large head loss gap $D_2D_1D$ and a small base loss gap $B_2C'D_2$ corresponding to a minimum profile reversing radius $q_{min}$, while FIG. 1*b* illustrates a large base loss gap $B_2C'D_2$ and a small head loss gap $D_2D_1D$ corresponding to a maximum profile reversing radius $q_{max}$. FIGS. 2–4 illustrate various widths of the base and head loss gaps as the profile reversing radius is shifted.

Referring to FIG. 4, the conveyor screw flanks are made as straight as possible, avoiding convex and concave shapes. The aim is to produce a pump with a profile-dependent loss gap that is as small as possible. The optimum profile-dependent loss gap width c (shown in FIGS. 2 and 4) will be found when the flank profile reversing radius is between the mid-radius (q=m) and the tooth diameter (q=1). Further, the ratio of the tooth head to the tooth height should be small, the tooth head width great and the distance between the meshing tooth flanks small. These requirements should be met uniformly over the pitch range of the rotor.

When the flank profile reversing radius is at the tooth diameter (i.e., q=1), the tooth head height is zero and the tooth width is greatest (i. e., H/2) at the tooth head. However, as shown in FIG. 3 when q=1, the distance between flanks is the greatest and the tooth base loss area is also the greatest. With a required minimal pitch at a constant tooth thickness this is not practicable. With only a small counter-pressure the reflux losses at q=1 are very great due to the large base gap shown in FIG. 3 and, therefore, the effective delivering flow is reduced.

At the other extreme, when the flank profile reversing radius q is equal to the mid radius (i.e., q=m) as shown in FIG. 3, the tooth width is greatest (i. e. H/2) at half the tooth height, and the tooth width smallest at the tooth head. Therefore, as shown in FIG. 3 when q=m only a profile—dependent head gap is present. When q=m, the distance between flanks is zero at the middle of the tooth and then increases to a maximum at the rotor diameter. When q=m the reaction forces are greatest, so that one must aim at locating the flank profile reversing radius q as far away from the pitch circle radius m as possible.

The tooth profile of the left and the fight tooth flank created with the dimensionless profile reversing radius q equal to the dimensionless mid-diameter m, is marked with cross symbols (see FIG. 3). The tooth profile which was created with the dimensionless profile reversing radius q equal to the minimum dimensionless profile reversing radius qmin, is identified with circle (dot) symbols. The tooth profile represented by the unaltered lines was created with the dimensionless profile reversing radius q equal to the dimensionless rotor diameter $R_K$.

Thus, FIG. 3 illustrates three axial section profiles (viewed from a section plane as in FIG. 2) of the intermeshing rotor teeth (flank and mating flank) with a thread-depth $G_\tau$ which is equal to the stretch AE and the tooth height, as well as the profile spacing from the flank and the mating flank. FIG. 3 illustrates a constant rotor radius $R_K$, a constant base circle radius $R_F$ and a constant pitch H.

The first rotor profile (cross symbols) is created with the dimensionless profile reversing radius q equal to the dimensionless mid-radius m. Here, the gap width c in the rolling circle is zero. In other words there is no base gap, but there are two large head gaps, when the dimensionless profile reversing radius q equals the dimensionless mid-radius m.

The second rotor profile (circle or dot symbols) is created with the dimensionless profile reversing radius q equal to the point designated by qmin. Here, by the slight gap width in the rolling circle, a small base gap is allowed and the head gap is reduced compared to the first profile.

The third rotor profile is created with the dimensionless profile reversing radius q equal to the dimensionless head radius r=1. Here, the gap in the rolling circle is maximized. A maximum profile-produced base gap is created and the profile-caused head gap is eliminated. These three axial section profiles show the range for the optimization of the gap width.

Thus, FIG. 3 illustrates different profiles that are created with constant rotor head diameter $D_K$, constant base circle diameter $D_F$ and constant pitch by varying the profile reversing point q. By shifting the profile reversing radius, the gap width c can be varied from a minimum (c=0 for q=m) to a maximum (q=1 dimensionless head diameter). Thus the gap width can be kept constant within the series of profiles.

It is, therefore, advantageous for the increase in the flank profile reversing radius q to commence at a minimum value which is greater than the mid-radius m (shown as q in FIGS. 3 and 4). Furthermore, the profile produced loss gap width c (shown in FIG. 4) should be kept constant and lie in the range of 0.1% to 1.5% (preferably 0.1% to 0.8%) of the rotor diameter $D_K(2\times R_K)$.

The minimum flank profile reversing radius q is approximately 8/10 of the pitch circle plus 0.2. The exact calculations takes place using the formula $q_{min}=0.6258\times e^{0.4886N\ddot{u}}$.

The various points and angles illustrated in FIGS. 1*a*, 1*b* and 2 are discussed below.

Points A and E represent the intersection of the tooth head circle radius r of one rotor and the base circle radius v of the other rotor. In the axial direction, the head gap width is zero at points A and E. The flanks of the rotors MI and MII touch at points A and E. While in this illustration the points are said to "touch", in practice it is well known that real rotors are provided with a peripheral clearance and a flank clearance to guarantee zero contact (i.e., a pre-set gap). Therefore, the word "touch" is used in this context throughout this application.

Points B and D represent the upper intersection of the head circle radiuses r of the rotors I and II. In the axial direction, the maximum head gap width is at points B and D.

Points B1 and D1 represent the intersection of the head circle radius r of the one rotor and the profile reversing radius of the other rotor. In the axial direction, the head gap width is zero at points B1 and D1. The flanks of the rotor MI and MII touch at points B1 and D1.

Points B2 and D2 represent the intersection of the profile reversing radiuses q of the rotors MII and MI. In axial direction, the head gap width is zero at points B2 and D2 (and the base gap begins). The flanks of the rotors MI and MII touch at points B2 and D2.

Point C represents the intersection of the mid-radiuses m of the rotors MII and MI. In axial direction, the gap width c, that is to be kept constant, is found at point C. The flanks of the rotors MI and MII have the distance c of the base gap at point C.

Point C' represents the intersection of the profile reversing radius q of the rotor MI and the stretch AE. In axial direction, a (middle) base gap width is at point C'. The flanks of the rotors MI and MII do not touch at point C'.

A first head gap is located along curves B-B1 and B1-B2 as well as the stretch B-B2. A second head gap is found along curves D-D1 and D1-D2 as well as the stretch D-D2. The shaded surfaces B2-C'-C and C-D2 show the base gap.

Point Rq is the profile reversing radius $q=Rq/R_K$.

Angle $a_{ü}$ is the half angle, where the rotors MI and MII intermesh and thus represents the half opening angle of a rotor bore free of play.

Angle $\alpha_v$ is the angle where the rotors MI and MII do not intermesh and thus is the angle of belt wrap of a rotor bore free of play.

Angle $\alpha_m$ is the angle between the straight lines MI, MII, for rotor MI starting from MI, for rotor MII starting from MII and the resulting intersection with the mid-radius $R_\tau(m)$ that occurs when generating the tooth base profile with the end point of the tooth head when rolling off the profile reversing radius Rq (q), from rotor MII on rotor MI in the case of rotor MI or vice versa in the case of rotor MII.

Angle $\alpha_{SK}$ is the tooth head profile angle that results when transversing the radiuses situated between $R_K(r=1)$ and Rq (q).

Angle $\alpha_{SF}$ is the tooth base profile angle that results when transversing the radiuses situated between $R_F$ (V) and Rq (q).

Angle $\alpha_{F1}$ (FIG. 2) is the flank angle in the axial section profile and that occurs along the normal at the profile reversing radius q and the tooth head radius r=1.

Angle β is the angle between the straight lines MI, MII, for rotor MI starting from MI, for rotor MI starting from MII and the end point of the tooth head profile, which occurs at the tooth head circle diameter with the radius $R_K$ (r=1), when rolling off the profile circle with radius Rq (q), from rotor MII on rotor MI in the case of rotor MI or vice versa in the case of rotor MII.

When delivering liquids with a high gas content, after a short operating period a high local compression heat often occurs. This affects, in particular, the rotor tooth nearest the pressure side. This compression heat may cause a local circumferential gap reduction and finally an erosion of the tooth by material contact (frictional engagement).

Figure 6:
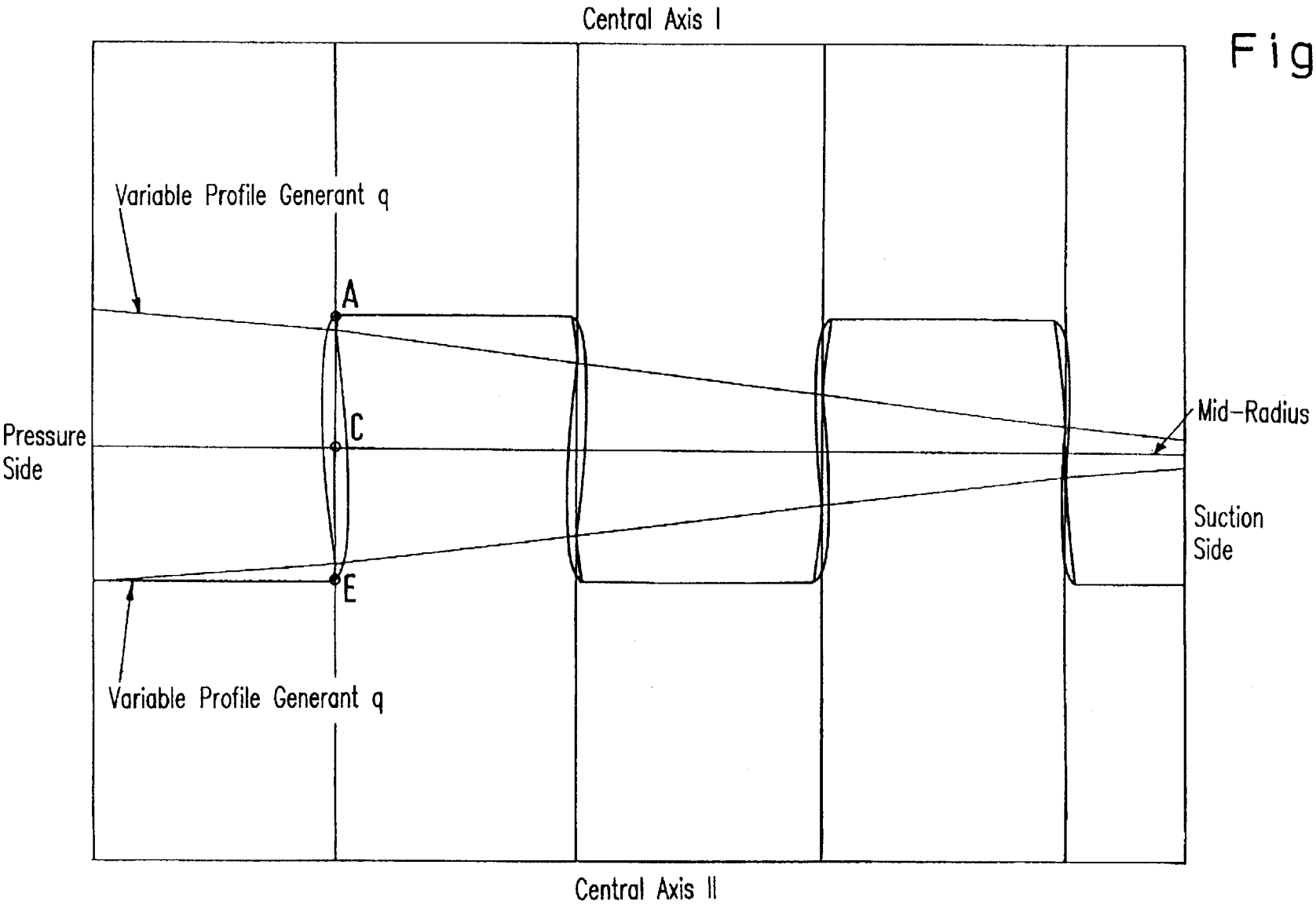
FIG. 6 is an axial section profile with continuously changing profile reversing radius.

Referring to FIG. 6, according to the invention, this problem is eliminated in that, with multistage rotors, only the stages nearest the suction side have the optimum loss gap c, discussed above. As a result thereof, in the axial direction of the rotor, gas is also compressed within the enlarged loss gaps. The resultant compression heat is distributed over a larger surface of the rotor and can be eliminated better. This prevents local overheating of the tooth head. A constant loss gap is illustrated in FIG. 2, while a variable loss gap is illustrated in FIG. 6.

The foregoing embodiment allows for production of a pump for delivering a liquid with high gas contents of more than 95% that can, for the first time, be designed reliably with optimum efficiency. According to the invention this is achieved in that, with the multi-stage rotor, the flank profile reversing radius q changes continuously, step-by-step or with multiple discontinuations, from the pressure side up to the stage nearest the suction side, in the direction of having an optimum loss gap c (shown in FIG. 6).

As a result of the inventive structure, a smaller leakage flow occurs along the tooth head, so that the tooth head is also subjected to less wear. In addition, an improved volumetric effect is obtained, which improves the overall efficiency and ensures longer life of the screw spindle pump.

By splitting the detrimental loss gap into an optimum mix of base and head loss gaps, according to the invention, and by taking into account the surface friction between the conveyor screw flanks (at the same differential pressure), especially when the pump will deliver a media that has low viscosity and a high gas content, the reflux loss can be significantly reduced. This results in an improvement in efficiency as well as reduced abrasive wear. In the case of gas-containing media, according to the invention, the resultant compression heat is optimally distributed. This counteracts a reduction of the circumferential gap at the tooth head, and reduces running noises.

With the solutions according to the invention for multi-stage rotors it is possible to allow incompressible media to flow back through gaps, and to compress compressible media over a longer path in the axial direction.

Irrespective of whether the profile reversing radius increases along the rotor length, the profile reversing radius q should always produce an optimum loss gap c between the teeth near the suction side of the pump. Further, the profile reversing radius q should be moved toward the tooth head for the teeth closer to the pressure side of the pump, as shown in FIG. 6. As a result thereof, local heat formation on the pressure side will be eliminated through the profile-produced loss gap c which varies over the length of the rotor as the profile reversing radius q changes. The profile-produced loss gap c will, therefore, become smaller towards the suction side.

Figure 8:
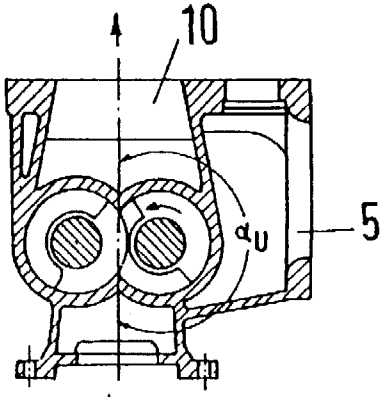
Fig.8 PRIOR ART
FIG. 8 shows on a smaller scale the screw spindle pump according to FIG. 7 in cross-section.
Figure 7:
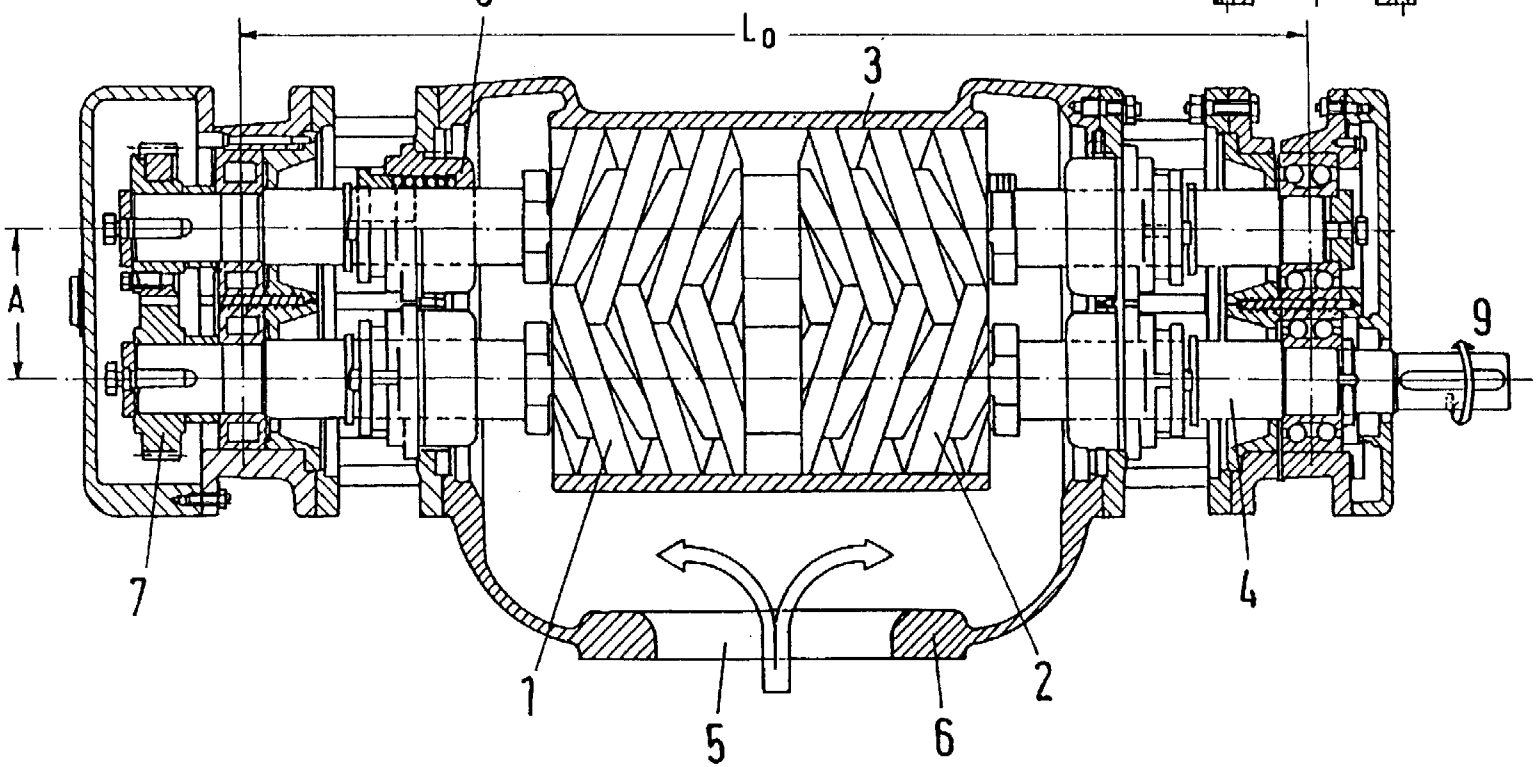
Fig.7 PRIOR ART
FIG. 7 shows, as prior art, in longitudinal section, a screw spindle pumps with external bearings.

Varying the profile-produced loss gap c, even at high gas rates, results in a shifting of the radius of application of the transverse force. This transverse force presses on the axis of the screw and the supporting bearing because of the differential of pressure on the suction side. This force causes deflection of the screw-spindle. The pressure side is shown in FIG. 7 and FIG. 8 (position 10) in the middle of the screws and the suction side (position 5) near the supporting bearing. Through the choice of profile as shown in FIG. 6, an optimal profile reversing point is used for slight loss flows on the suction side and, on the pressure side along the screw axis, an increased loss gap is created by shifting the profile reversing radius. In this way, the pressure build-up is shifted along the rotor axis toward the suction side as is the resulting transverse force. This force then acts more directly on the supporting bearings arranged on the suction side, whereby the deflection is reduced and higher differential pressures can be allowed. The transverse force is shifted from the center on the pressure side to the supporting bearings on the suction side, so that the deflection of the shaft is reduced. Such pumps are suitable in particular for delivering crude oil directly at the borehole where media interspersed with gas can be expected (multi-phase delivering).

We claim:

1. A pair of conveyor screws for rotating positive-displacement pumps, the conveyor screws including a rotor and a contra-rotor, wherein said conveyor screws comprise a screw spindle pump and rotate with zero contact between said conveyor screws, said conveyor screws being positioned within a housing and rotating at a same speed, said conveyor screws including teeth, said teeth having opposing flanks extending along a length of said teeth, said conveyor screws forming loss gaps and having a same thread depth, a same number of threads and flank pro flies which are symmetrical, and said conveyor screws including a tooth base positioned below a flank profile reversing radius and a tooth head positioned above said flank profile reversing radius, wherein a profile-produced loss gap width in an axial section on a mid-radius is kept constant for a specific rotor diameter by shifting the flank profile reversing radius as a function of a rotor pitch.

2. A pair of conveyor screws according to claim 1, wherein the flank profile reversing radius varies as a ratio of diameter to rotor pitch varies.

3. A pair of conveyor screws according to claim 1, wherein, when a ratio of base diameter to head diameter is constant, the flank profile reversing radius increases above the mid-circle to a maximum value as the rotor pitch decreases.

4. A pair of conveyor screws according to claim 3 wherein the increase of the flank profile reversing radius commences at a minimum value which is greater than the pitch circle.

5. A pair of conveyor screws according to claim 1, wherein the profile-produced loss gap width is kept constant and lies in the range 0.1% to 1.5% of the rotor diameter.

6. A pair of conveyor screws for rotating positive-displacement pumps, the conveyor screws comprising multi-stage rotors including a rotor and a contra-rotor, wherein said conveyor screws comprise a screw spindle pump and rotate with zero contact between said conveyor screws, said conveyor screws being positioned within a housing and rotating at a same speed, said conveyor screws including teeth, said teeth having opposing flanks extending along a length of said teeth, said conveyor screws forming loss gaps and having a same thread depth, a same number of threads and flank profiles which are symmetrical, and said conveyor screws including a tooth base positioned below a flank profile reversing point and a tooth head positioned above said flank profile reversing point, wherein a profile-produced loss gap height in an axial section on a pitch circle is determined for a specific rotor diameter by shifting the flank profile reversing point as a function of a rotor pitch;

wherein only stages nearest a suction side have an optimum profile-produced loss gap height.

7. A pair of conveyor screws according to claim 6, wherein the flank profile reversing radius changes continuously across said stages, step-by-step or with multiple discontinuations in the direction of its optimum position.

8. A pump comprising:

at least two intermeshed screws, said screws including a plurality of teeth, said screws having a pitch and a diameter; and a gap having a gap width formed between adjacent teeth of said teeth, wherein said gap width is determined by a profile reversing radius along said teeth, said profile reversing radius being positioned along said teeth depending on a ratio of said pitch to said diameter.

9. A pump as in claim 8, wherein said gap prevents said adjacent teeth from making contact.

10. A pump as in claim 8, wherein said gap width has a width in a range of 0.001 to 0.015 of said diameter.

11. A pump as in claim 8, wherein:

said screws further include a base having a base diameter;

a hub ratio Nü comprises a ratio of said base diameter to said screw diameter; and a minimum profile reversing radius of said profile reversing radius comprises $0.6258 \times e^{0.4886 N\ddot{u}}$.

12. A pump as in claim 8, wherein:

said intermeshed screws each have an axis;

said gap includes a base gap and two head gaps;

each said head gap extends between said adjacent teeth from said profile reversing radius in a direction away from said axis of a respective intermeshed conveyor screw of said intermeshed screws to said diameter;

said base gap extends from said profile reversing radius of a first tooth of said adjacent teeth to said profile reversing radius of a second tooth of said adjacent teeth.

13. A pump as in claim 12, wherein said base gap is up to 24 times larger that said two head gaps.

14. A pump as in claim 12, wherein said pump further comprises a suction end and a pressure end, said base gap between said adjacent teeth at said suction end being progressively smaller than that of said adjacent teeth at said pressure end.

15. A pump as in claim 8, wherein:

said pump further comprises a suction end and a pressure end;

each of said screws has an axis; and said profile reversing radius along said teeth at said suction end being progressively further from said axis than that of said teeth at said pressure end.

16. A screw pump comprising:

first and second meshing screw rods counter-rotating at a speed within a bore of a casing, said first and second screw rods having a pitch, a predetermined number of starts and a thread depth, said first and second screw rods each comprising a helical gearing including teeth, each tooth of said teeth including a base, a tip and a pair of symmetrical opposing flank profiles, said flank profiles including a flank profile reversing radius, an addendum flank above said flank profile reversing radius and a tooth flank below said flank profile reversing radius, said thread depth comprising a distance between said tip and said base, said screw pump further comprising a plurality of leakage gaps between each said moth of said first meshing screw rod and each counter tooth of said second meshing screw rod, said leakage gaps having a width, wherein a radius of said flank profile reversing radius is variable such that said width of said leakage gaps is constant for a predetermined tooth tip diameter and a predetermined screw pitch.

17. A pump for pumping a substance formed by a method comprising steps of:

providing at least two intermeshed screws, said screws having a pitch and a diameter;

forming a plurality of teeth on said screws such that a gap is formed between adjacent teeth of said teeth, each tooth of said teeth having a profile reversing radius;

determining a gap width of said gap for said substance;

forming said gap width between said adjacent teeth by varying said profile reversing radius along said tooth as a ratio of pitch to diameter varies.

18. A pump formed by a method as in claim 17, wherein each said tooth has a midpoint, said method further comprising a step of forming said profile reversing radius between said midpoint and said diameter.

19. A pump formed by a method as in claim 17, wherein said gap width has a width in the range of 0.001 to 0.015 of said diameter.

* * * * *